US007040616B2

(12) United States Patent
Stemmle

(10) Patent No.: US 7,040,616 B2
(45) Date of Patent: May 9, 2006

(54) METHOD AND SYSTEM FOR HIGH SPEED DIGITAL METERING USING OVERLAPPING ENVELOPES

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 504 days.

(21) Appl. No.: 10/320,888

(22) Filed: Dec. 17, 2002

(65) Prior Publication Data

US 2004/0113356 A1 Jun. 17, 2004

(51) Int. Cl.
*B65H 29/68* (2006.01)
*B65H 29/66* (2006.01)
*B65H 29/26* (2006.01)

(52) U.S. Cl. ..... 271/270; 271/182; 271/191; 271/202; 198/792; 198/341.1

(58) Field of Classification Search ..... 271/182, 271/191, 202; 198/792, 341.1
See application file for complete search history.

(56) References Cited

U.S. PATENT DOCUMENTS 3,994,221 A * 11/1976 Littleton ..... 101/227
4,320,894 A * 3/1982 Reist et al. ..... 271/277
4,364,552 A 12/1982 Besemann ..... 271/182
4,436,302 A * 3/1984 Frye et al. ..... 271/202
4,538,161 A * 8/1985 Reist ..... 347/4

FOREIGN PATENT DOCUMENTS

DE 3544359 5/1987
EP 0244650 4/1987

* cited by examiner

*Primary Examiner*—Donald P. Walsh
*Assistant Examiner*—Kenneth W Bower
(74) *Attorney, Agent, or Firm*—Michael J. Cummings; Charles R. Malandra, Jr.; Angelo N. Chaclas

(57) ABSTRACT

A transporting system and method for use in a high velocity document processing system using lower velocity print technology. The invention including an upstream transport conveying spaced apart documents at a first transport velocity. A deceleration transport decelerates documents from the high speed to a lower print velocity before passing the documents a print transport. A sensor located at the deceleration transport, detects the presence of documents at the deceleration transport, and triggers the deceleration profile to be performed on the document. The deceleration transport is controlled such that a leading portion of a document that is being decelerated overtakes a trailing portion of a downstream document that already traveling at the lower print velocity in the control of the print transport. An overlapping arrangement urges the lead portion of the upstream document to overlap on top of the trailing portion of the downstream document when the upstream document overtakes the downstream document. A print head prints on the transported documents at the print transport velocity.

27 Claims, 6 Drawing Sheets

METHOD AND SYSTEM FOR HIGH SPEED DIGITAL METERING USING OVERLAPPING ENVELOPES

TECHNICAL FIELD

The present invention relates to a module for printing postage value, or other information, on an envelope in a high speed mass mail processing and inserting system. Within the printing module, the printing device may operate at a lower velocity than other parts of the system. To allow the documents to be slowed for printing without causing jams, the present invention overlaps documents as they are transported and printed at the reduced speed.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and Advanced Productivity System (APS™) inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

Current mail processing machines are often required to process up to 18,000 pieces of mail an hour. Such a high processing speed may require envelopes in an output subsystem to have a velocity in a range of 80–85 inches per second (ips) for processing. Leading edges of consecutive envelopes will nominally be separated by a 200 ms time interval for proper processing while traveling through the inserter output subsystem. At such a high rate of speed, system modules, such as those for sealing envelopes and putting postage on envelopes, have very little time in which to perform their functions. If adequate control of spacing between envelopes is not maintained, the modules may not have time to perform their functions, and jams and other errors may occur. In particular, postage meters are time sensitive components of a mail processing system. Meters must print a clear postal indicia on the appropriate part of the envelope to meet postal regulations. The meter must also have the time necessary to perform bookkeeping and calculations to ensure the appropriate funds are being stored and printed.

A typical postage meter currently used with high speed mail processing systems has a mechanical print head that imprints postage indicia on envelopes being processed. Such conventional postage metering technology is available on Pitney Bowes R150 and R156 mailing machines using model 6500 meters. The mechanical print head is typically comprised of a rotary drum that impresses an ink image on envelopes traveling underneath. Using mechanical print head technology, throughput speed for meters is limited by considerations such as the meter's ability to calculate postage and update postage meter registers, and the speed at which ink can be applied to the envelopes. In most cases, solutions using mechanical print head technology have been found adequate for providing the desired throughput of approximately five envelopes per second to achieve 18,000 mail pieces per hour.

However, use of existing mechanical print technology with high speed mail processing machines presents some challenges. First, some older mailing machines were not designed to operate at such high speeds for prolonged periods of time. Accordingly, solutions that allow printing to occur at lower speeds may be desirable in terms of enhancing long term mailing machine reliability.

Another problem is that many existing mechanical print head machines are configured such that once an envelope is in the mailing machine, it is committed to be printed and translated to a downstream module, regardless of downstream conditions. As a result, if there is a paper jam downstream, the existing mailing machine component could cause even more collateral damage to envelopes within the mailing machine. At such high rates, jams and resultant damage may be more severe than at lower speeds. Such damage often includes the result of moving envelopes crashing into the edges of stationary downstream envelopes. Accordingly, improved control and lowered printing speed, while maintaining high throughput rate in a mechanical print head mailing machine could provide additional advantages.

Controlling throughput through the metering portion of a mail producing system is also a significant concern when using non-mechanical print heads. Many current mailing machines use digital printing technology to print postal indicia on envelopes. One form of digital printing that is commonly used for postage metering is thermal inkjet technology. Thermal inkjet technology has been found to be a cost effective method for generating images at 300 dpi on material translating up to 50 inches per second. Thus, while thermal inkjet technology is recognized as inexpensive, it is difficult to apply to high speed mail production systems that operate on mail pieces that are typically traveling in the range of up to 80 to 85 ips in such systems.

As postage meters using digital print technology become more prevalent in the marketplace, it is important to find suitable substitutes for the mechanical print technology meters that have traditionally been used in high speed mail production systems. This need for substitution is particularly important as it is expected that postal regulations will require phasing out of older mechanical print technology meters, and replacement with more sophisticated digital based meters. Although digital print technology exists that is capable of printing the requisite 300 dpi resolution on paper traveling at 80 to 85 ips, such devices are so expensive as to be considered cost prohibitive. Accordingly, it would be beneficial to have a solution that would allow lower velocity digital print technology, like thermal inkjet technology, to be utilized with the high speed mail production systems.

Some systems that have been available from Pitney Bowes for a number of years address some related issues.

These systems utilize R150 and R156 mailing machines using 6500 model postage meters installed on an inserter system. The postage meters operate at a slower velocity than that of upstream and downstream modules in the system. When an envelope reaches the postage meter module, a routine is initiated within the postage meter. Once the envelope is committed within the postage meter unit, this routine is carried out without regard to conditions outside the postage meter. The routine decelerates the envelope to a printing velocity. Then, the mechanical print head of the postage meters imprints an indicia on the envelope. After the indicia is printed, the envelope is accelerated back to close to the system velocity, and the envelope is transported out of the meter.

One problem with this current solution is that the conventional postage meters are inflexible in adjusting to conditions present in upstream or downstream meters. For example, if the downstream module is halted as a result of a jam, the postage meter will continue to operate on whatever envelope is within its control. This often results in an additional jam, and collateral damage, as the postage meter attempts to output the envelope to a stopped downstream module.

Another problem with the current solution is that it is very sensitive to gaps between consecutive envelopes. In the process of slowing down the documents, the gap between documents is reduced, and an error in the spacing between documents becomes more significant. The inserter may not be able to maintain controlled spacing between documents accurately enough to prevent collisions between consecutive envelopes during the slow down process. This problem is further exacerbated because the R150 and R156 mailing machines are a bit too long to have time to carry out the routine on the envelopes, and to still have some margin for error in the arrival of a subsequent envelope. As such, a module with better space utilization and less sensitivity to gap variations is desirable.

SUMMARY OF THE INVENTION

The present invention provides a transporting system and method for use in a high velocity document processing system using lower velocity print technology. A transport path through the system is made up of an upstream transport conveying spaced apart documents at a first transport velocity. This first transport velocity represents the high processing speeds available in current high speed inserter machines. Downstream of the upstream transport, a deceleration transport decelerates documents from the high speed to a lower print velocity before passing the documents to a print transport. Both the upstream transport and the lower speed print transport normally operate at their respective constant velocities. The deceleration transport adjusts to match the speeds of the respective upstream or downstream modules when receiving and passing documents from them.

Preferably, a sensor located at the deceleration transport, detects the presence of documents at the deceleration transport, and triggers the deceleration profile to be performed on the document. After it is sensed that a document has passed out from the deceleration transport, the deceleration transport must accelerate back to the higher transport velocity in order to receive the next document.

The deceleration transport is further controlled such that a leading portion of a document being decelerated overtakes a trailing portion of a downstream document that is already traveling at the lower print velocity in the control of the print transport. Unlike conventional systems, there is no need or attempt to rigorously maintain and control a gap between subsequent documents.

The invention further includes an overlapping arrangement whereby the lead portion of the upstream document is urged to overlap on top of the trailing portion of the downstream document when the upstream document overtakes the downstream document. Such overlapping arrangement may cause a rear portion of the lead document to be positioned downward relative to the overtaking upstream document. Alternatively, the upstream document may be upwardly biased, or some combination of upward and downward biasing may be used. In any case, the lead portion of the trailing document should be positioned overlapping on a trailing portion of a leading document.

The overlapped documents are transported to a print head contiguous with the print transport. The print head prints the desired marks on the overlapped documents as they pass beneath at the print transport velocity.

Further details of the present invention are provided in the accompanying drawings, detailed description and claims.

DETAILED DESCRIPTION

Figure 1:
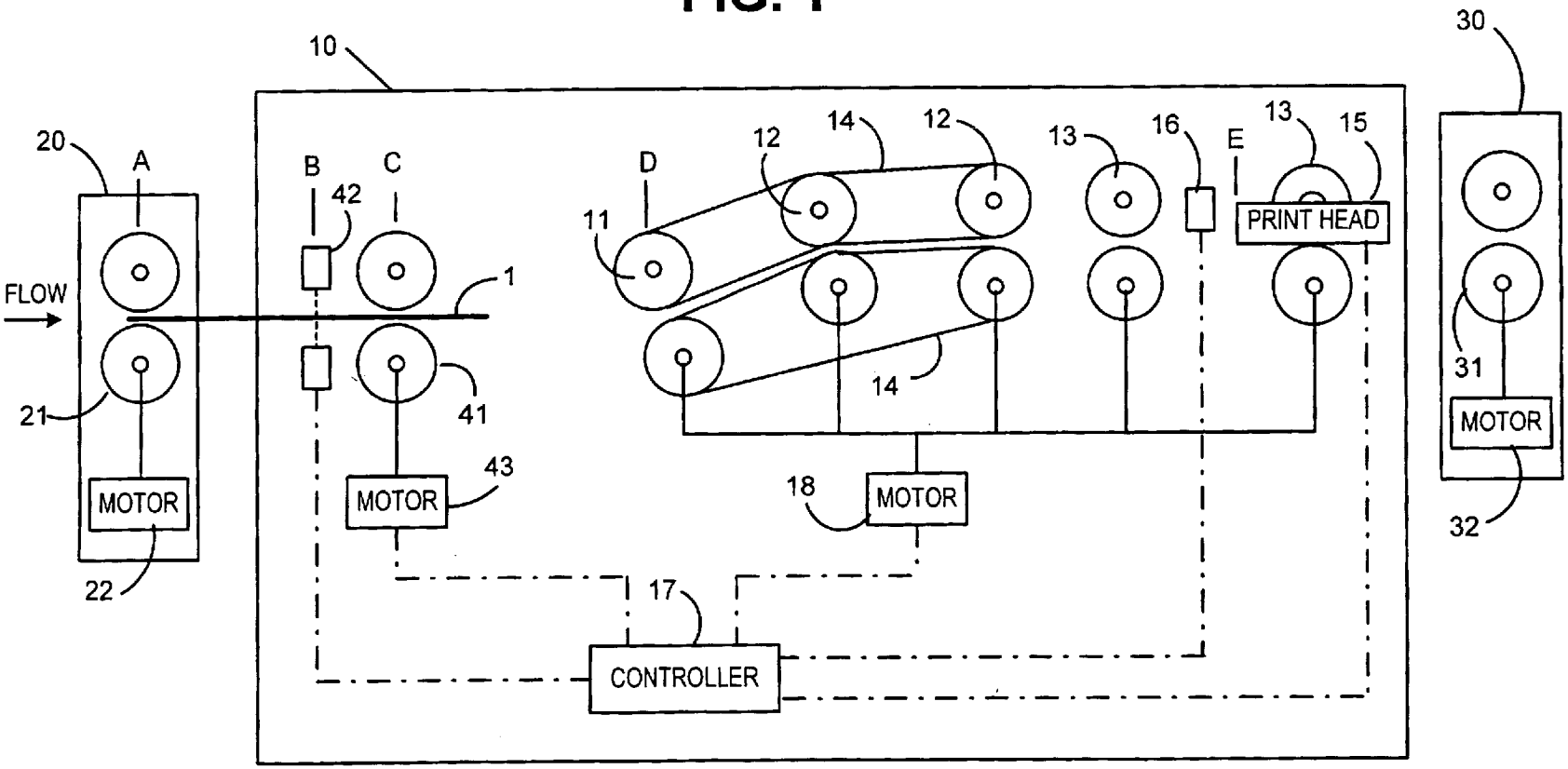
FIG. 1 is a diagram of a postage printing module utilizing the present invention.

As seen in FIG. 1, the present invention includes a postage printing module 10 positioned between an upstream module 20 and a downstream module 30. Upstream and downstream modules 20 and 30 can be any kinds of modules in an inserter output subsystem. Typically the upstream module 20 could include a device for wetting and sealing an envelope flap. Downstream module 30 could be a module for sorting envelopes into appropriate output bins or a stacker module.

Postage printing module 10, upstream module 20, and downstream module 30, all include transport mechanisms for moving an envelope 1 along the processing flow path. In the depicted embodiment, the upstream module 20 includes nip rollers 21 driven by motor 22. Similarly, the downstream module 30 includes a transport comprised of nip rollers 31 driven by motor 32. In the preferred embodiment, rollers 21 and 31 are hard-nip rollers to minimize variation. As an alternative to nip rollers, the transport mechanism and transport path may comprise sets of conveyor belts (like belts 14) between which envelopes are transported.

Print head 15 is preferably located near the output end of the print transport portion of the postage printing module 10. To comply with postal regulations the print head 15 should be capable of printing an indicia at a resolution of 300 dots per inch (dpi). In the preferred embodiment, the print head 15 is an ink jet print head capable of printing 300 dpi on media traveling at 50 ips. Alternatively, the print head 15 can be any type of print head, including those using other digital or mechanical technology, which may benefit from printing at a rate less than the system velocity.

In the preferred embodiment, the transport within print module 10 may be identified in several segments. At the upstream end of the postage printing module 10, a first segment is comprised of a set of deceleration roller nips 41 that are driven at a variable speed by servo motor 43. Downstream of the deceleration roller nips 41, the transport mechanism is a dual belt transport arrangement comprised of inlet rollers 11 and further downstream rollers 12 around all of which belts 14 are driven. In the preferred embodiment depicted in FIG. 1, the downstream rollers 12 are positioned at a higher elevation in the transport path than the inlet rollers 11. As a result, envelopes are transported in a sloped upward path between belts 14. Downstream of the belts 14, nip rollers 13 further transport envelopes as the print head 15 performs printing operations upon them. In the preferred embodiment, roller sets 11, 12 and 13 are driven at a uniform print velocity by one or more motors 18 during operation.

In FIG. 1, deceleration nips 41 are depicted as being part of the print module 10, however, it will be understood by one skilled in the art that such rollers may also be part of a downstream portion of upstream module 20, or even in their own intermediate module between upstream module 20 and print module 10.

As an envelope 1 travels through the system depicted in a preferred embodiment shown in FIG. 1, it is initially transported at a constant velocity of approximately 85 inches per second (ips) in upstream module 20. From the upstream module 20, the envelope 1 is passed to deceleration rollers 41 in the print module 10. As the lead edge envelope 1 arrives at deceleration rollers 41, deceleration rollers 41 are rotating at a speed equivalent to the module 20 speed of 85 ips. As long as any portions of envelope 1 are engaged by both rollers 21 and 41, rollers 41 continue to operate at the same speed as rollers 21. When envelope 1 comes under the sole control of deceleration rollers 41, it is decelerated to a preferred print velocity of approximately 42.5 ips. Preferably, this deceleration is Initiated based on sensing the presence of the envelope 1 at the deceleration roller 41 with optical sensors 42. Based on a signal from sensors 42 a controller 17 controls the motion of deceleration rollers 41 via servo motor 43. The deceleration rollers 41 pass the envelope 1 to the inlet rollers 11. So long as envelope 1 is in the control of both nip rollers 41 and 11, rollers 41 continue to operate at 42.5 ips. When the trail edge of envelope 1 passes by nip rolls 41, controller 17 signals motor 43 to accelerate nip rollers 41 back up to the initial 85 ips speed prior to the arrival of the lead edge of the next envelope. Rollers 11, 12, 13 and associated belts 14 provide transport at the constant print velocity of 42.5 ips. A lead edge sensor 16 detects the presence of envelopes approaching the print head 15, and the controller 17 activates the print head 15 to print upon envelope 1 as appropriate.

As an alternative to relying solely on sensors for sensing positions of documents, the controller 17 may receive encoder pulses from motors 22, 43, or 18. These pulses can be interpreted by controller 17 as displacements, and such displacement information may supplement the sensor information for greater accuracy. Known techniques for predicting positions of documents based on known past locations and subsequent velocities may also be used to determine when events should be triggered, as opposed to relying on sensors for immediate tripping of a routine.

Figure 2A:
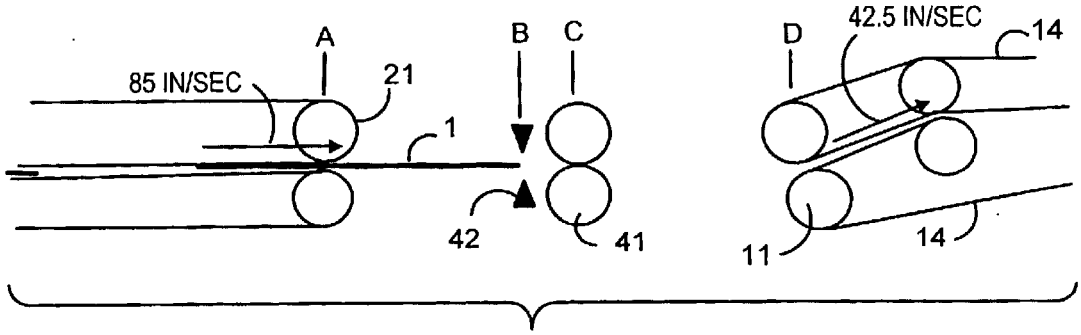
FIGS. 2A–2D depict a first exemplary embodiment for overlapping envelopes.

A process for creating an overlap of consecutive envelopes using the embodiment of FIG. 1 is depicted in FIGS. 2A–2D. In FIG. 2A, envelope 1 is still within the control of the upstream module 20 and is passing between the upstream roller nips 21 at location A at a high upstream velocity of 85 ips. The arrival of the envelope 1 at the deceleration roller nips 41 is sensed by optical sensor 42. Preferably optical sensor 42 is located at location B, which is at, or immediately upstream, from location C, the position of the deceleration rollers 41. After the arrival of the envelope 1 has been sensed by sensor 42, controller 17 calculates an appropriate time delay until the trail edge of envelope 1 passes nip rollers 21. At that time, envelope 1 is within the sole control of the deceleration rollers 41, the envelope 1 is decelerated from 85 ips to 42.5 ips.

Figure 6:
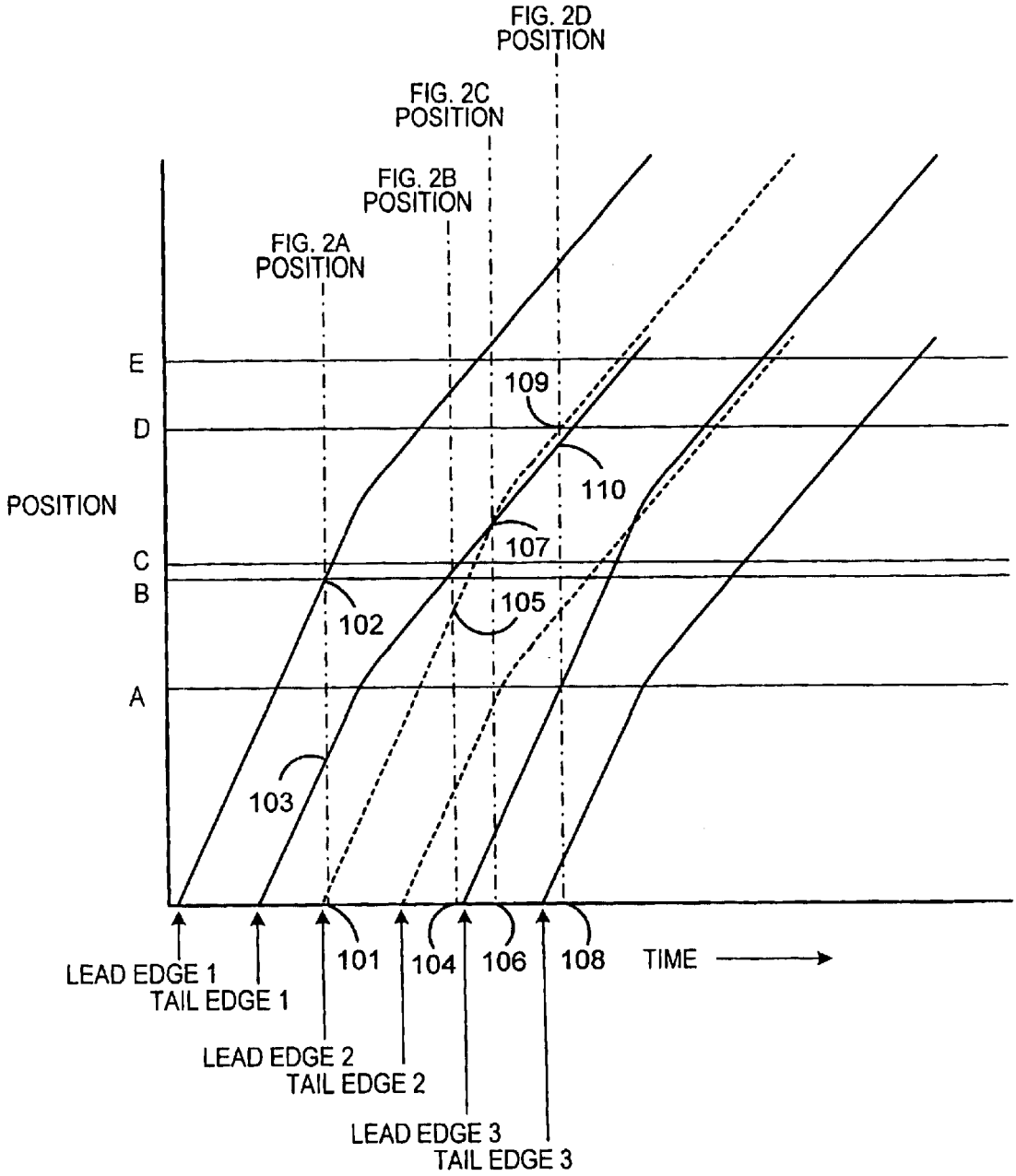
FIG. 6 depicts an exemplary timing diagram for displacement of documents within a system utilizing the present invention.

The relative positions of lead and tail edges of documents during the overlapping process are further depicted over time in the graph in FIG. 6. On the vertical axis, positions within the system, including locations A, B, C, D, and E, are represented. The locations of documents within the system are therefore represented with respect to time by the lines on the graph. The locations on the vertical axis correspond to the locations shown in FIGS. 1 and 2. A first pair of lines starting from the left side of the graph depict the LEAD EDGE 1 and TRAIL EDGE 1 of envelope 1. Similarly, the subsequent positions of lead and trail edges of envelopes 2 and 3 are shown over time. Thus, for example, a situation similar to that depicted in FIG. 2A is shown on the left side of the graph of FIG. 6 at a point in time 101 when the LEAD EDGE 1 is almost to location B as shown at 102, and the TRAIL EDGE 1 is still approaching location A, as shown at 103.

Figure 2B:
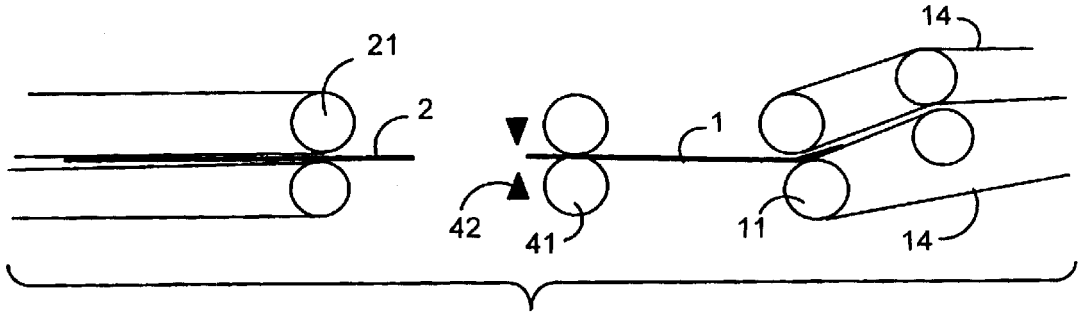

As seen in FIG. 2B, after envelope 1 has been decelerated to the lower print velocity of 42.5 ips, it is passed from rollers 41 to the inlet rollers 11 at position D for the lower speed portion of the print transport. Rollers 41 continue to operate at the lower velocity of 42.5 ips until envelope 1 has passed completely out of the deceleration rollers 41. At that time rollers 41 are immediately accelerated back to the upstream transport velocity of 85 ips, so that a subsequent envelope 2 may be accepted. Meanwhile, the upstream envelope 2 is starting to arrive from the upstream module 20 as shown at 105 in FIG. 6 at time 104.

Figure 2C:
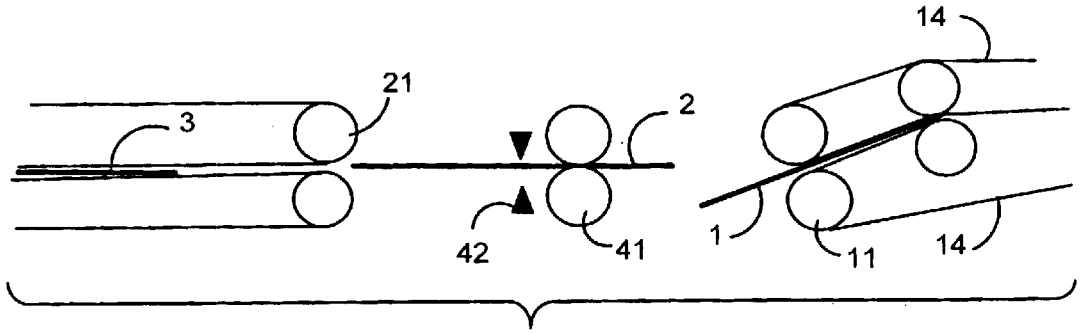

Shortly afterwards, as seen in FIG. 2C, envelope 1 has started to travel up a sloped path formed by rollers 11 and 12 and belts 14. In doing so, a rear portion of envelope 1 that has not passed inlet rollers 11 is lowered below the horizontal plane in which it was previously traveling. At the same time, the sensor 42 has indicated that envelope 2 is within the deceleration roller 41 and controller 17 causes the deceleration rollers to decelerate envelope 2 after its trail edge passes rollers 21 from its initial velocity of 85 ips. The deceleration of envelope 2 is controlled so that a leading portion of envelope 2 overtakes a trailing portion of envelope 1, before envelope 2 is completely reduced to the print velocity of 42.5 ips. This event is depicted at 107 in FIG. 6 at time 106.

Figure 2D:
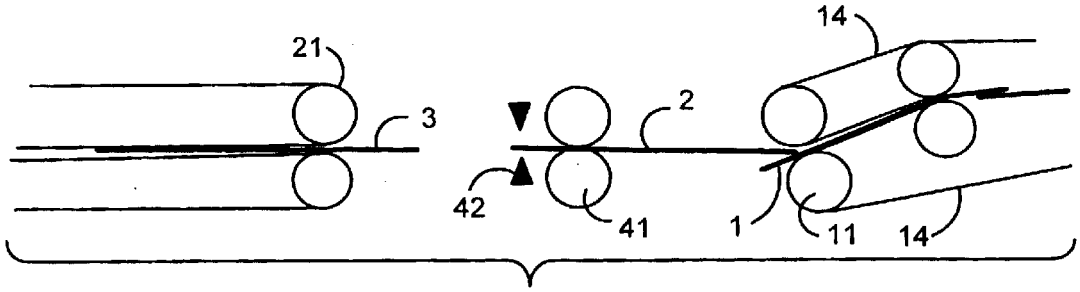

In FIG. 2D, as a result of the controlled deceleration of envelope 2, an overlap of the lead portion of envelope 2 over a trailing portion of envelope 1 is created. The overlapped envelopes are driven together between the inlet roller 11 and are further driven downstream for processing. This event is depicted at time 108 in FIG. 6. Lead edge 2 at 109 overlaps TRAIL EDGE 1 at 110.

Once again referring to FIG. 6, a graphical depiction of the overlapping action can be seen. It is seen that the dashed line for the LEAD EDGE 2 overtakes the solid line for the TRAIL EDGE 1 at point 107, at a time when envelope 2 is within the control of the deceleration rollers 41 at location C. Further, it is seen that at time 106, the lead edge of envelope 2 overtakes the trail edge of envelope 1 during the deceleration process of envelope 2, and before the trail edge of envelope 1 has passed though the inlet nips at location D. While FIG. 6 is not to scale, it does depict the cyclical overlapping that occurs as a procession of envelopes is handled by the print module 10.

Figure 3A:
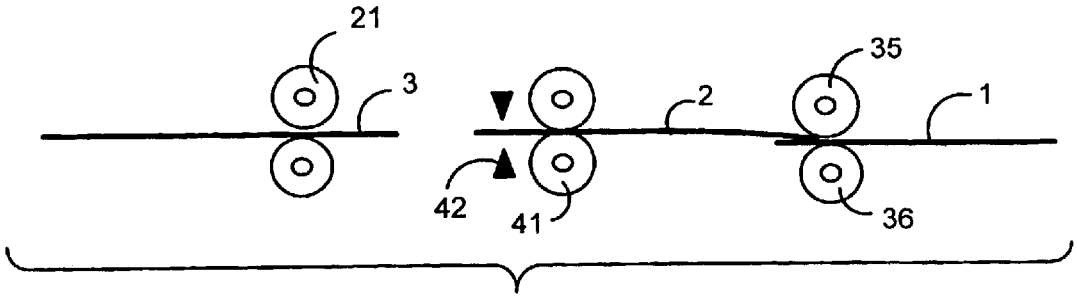
FIGS. 3A–3C depict further exemplary embodiments for overlapping envelopes

FIG. 3A depicts an alternative to the overlapping arrangement depicted in FIGS. 1 and FIGS. 2A–2D. Instead of the upward sloped transport path, the alternative embodiment includes rollers 35 and 36 which form a horizontal transport path that is below the upstream horizontal transport path between the deceleration rollers 41. Accordingly, a rear portion of the lead envelope 1, within the control of rollers 35 and 36, will be below a leading portion of the overtaking trailing envelope 2.

As depicted in FIG. 3A, a lead edge of the envelope 2 is guided downward on top of the rear portion of envelope one by the rotation of roller 35. In a preferred embodiment, roller 35 may have a larger radius to provide a more gradual redirection of envelopes coming into contact with it.

Figure 3B:
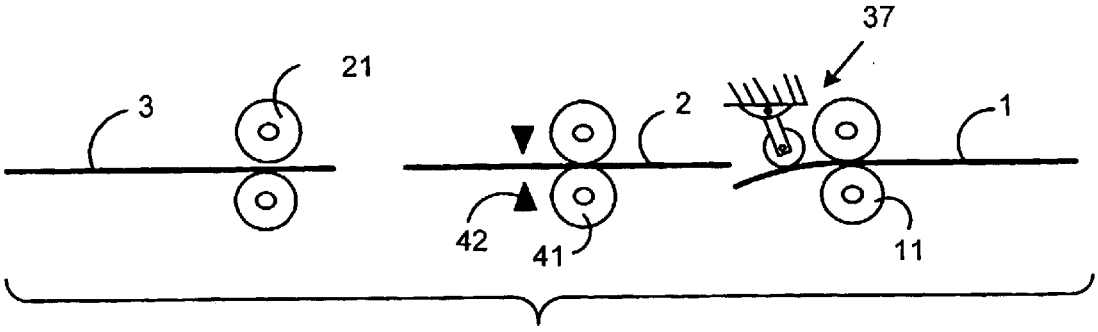

Yet another alternative overlapping arrangement is depicted in FIG. 3B. A roller arrangement 37 is pivotably interposed in the document flow path so that a trailing edge of the lead envelope 1 is biased downwards as the leading edge of the trailing envelope 2 overtakes envelope 1. In this arrangement, the roller arrangement 37 is positioned above the document flow path, and is positioned proximal to the inlet rollers 11.

Figure 3C:
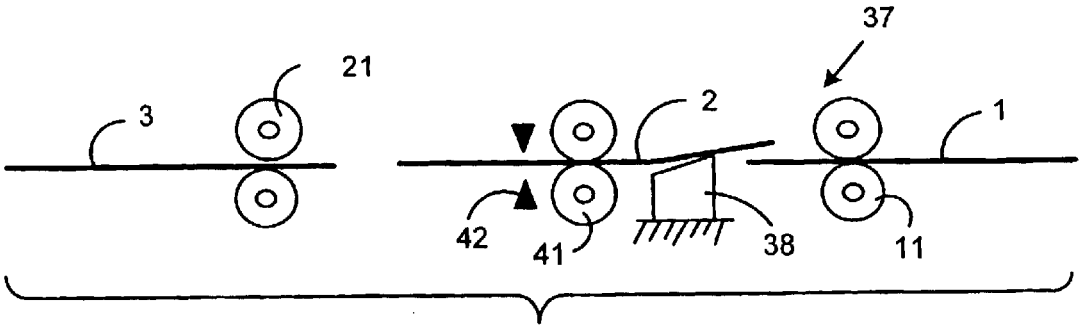

In a further alternative overlapping arrangement shown in FIG. 3C, a leading portion of the trailing envelope 2 is biased upward by a ramp structure 38, so that once again, the overlap of the lead edge of the trailing envelope 2 is assured to be positioned on top of the trail edge of the leading envelope 1, as envelope 2 undergoes its deceleration to the print velocity. It will further be understood that the ramp structure 38 can be used to provide a downward bias in place of the roller arrangement 37 in FIG. 3B. Similarly, the roller arrangement 37 can be swapped for the ramp structure 37 in FIG. 3C.

Figure 4:
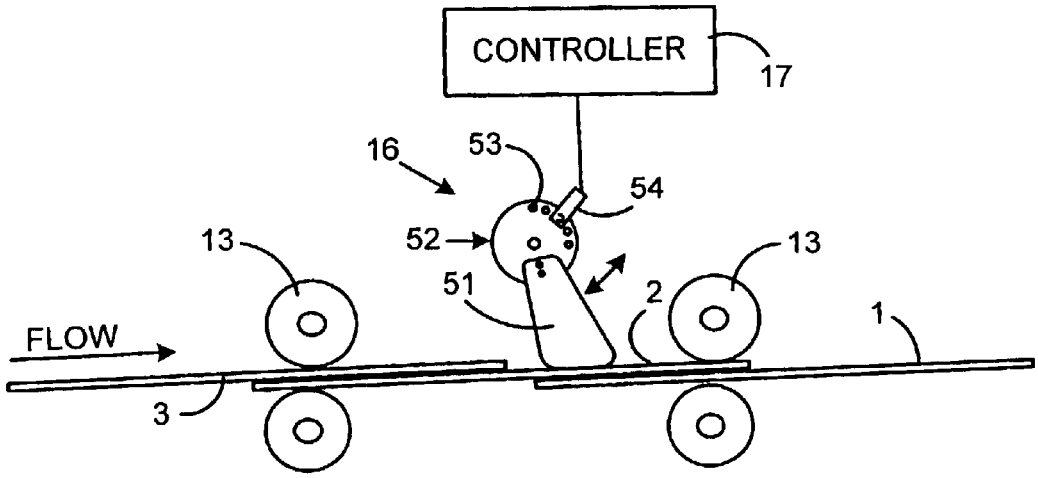
FIG. 4 depicts an exemplary sensor for detecting leading edges of overlapped documents.

In FIG. 4, a more detailed embodiment of lead edge sensor 16 is depicted. In this preferred embodiment, lead edges of overlapped envelopes 1, 2, and 3 are detected as a consequence of the movement of a member 51 that drags along the surface of the envelopes moving beneath. The member 51 is mounted on a rotating disc 52. As envelopes move beneath the member 51 variations in the surface will cause the attached rotating disc 52 to move about its axis. The most radical movement will occur when a sudden obstruction, such as an edge, forces the member 51 to rotate sharply to the right and slightly upward. The greater angular displacement of the disc 52 can be interpreted to indicate that a lead edge of a document is present.

Preferably, displacements of the member 51 are measured by an encoder-like arrangement in which movement of holes 53 on the outer perimeter of the disc 52 are sensed by an optical sensor 54. The sensor 54 generates pulses corresponding to the movement of the holes 53 by the sensor 54. The pulses are communicated to controller 17 that interprets the pulses to identify lead edges of envelopes when a sufficient displacement has occurred over short enough of a time. Based on the detection of the lead edge, the print head 15 may print on a leading portion of the surface of an overlapped envelope.

Figure 5:
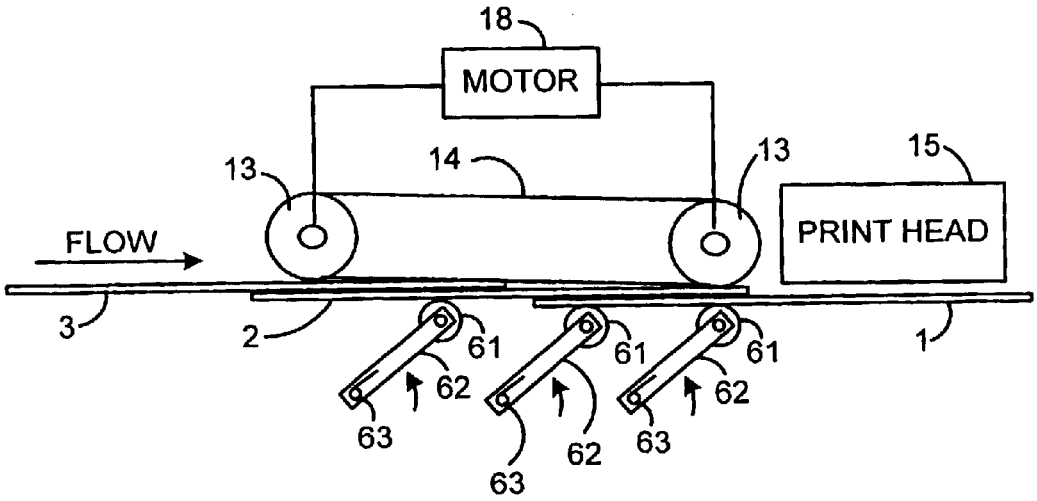
FIG. 5 depicts an exemplary transport system for maintaining the top surfaces of overlapped documents at a relatively constant distance from an overhead print head.

A further feature to assist in proper printing on overlapped envelopes is depicted in FIG. 5. In preferred embodiments, print head 15 uses ink jet technology. Ink jet technology preferably prints onto surfaces of documents within a uniform range of distances below the print head 15. Accordingly, varying thicknesses resulting from overlapping, or from different thicknesses of mail pieces can result in potential difficulties. To address the problem of presenting surfaces a uniform distance below the print head 15, the embodiment in FIG. 5 provides a transport arrangement that allows variations in thickness if the documents being transported to be absorbed by movable rollers below the transport plane, while keeping the print surfaces a common distance below the print head 15.

Accordingly, rollers 13 with a belt 14 are fixedly positioned above the transport path. The top surfaces of the overlapped documents will consistently be controlled by the position of the rollers 13 and plane formed by belt 14. Meanwhile, below the transport path, rollers 61 are individually mounted and are vertically movable. Preferably, the rollers 61 are mounted on moving mounting arms 62, which are rotatably mounted at the end distal to the rollers 61. The moving mounting arms 62 are upwardly biased by springs 63. Thus, the position of the rollers 61 may vary relative to the upper plane formed by rollers 13 and belt 14 above, depending on the varying thickness of the overlaps, and of the mail pieces.

Figure 7A:
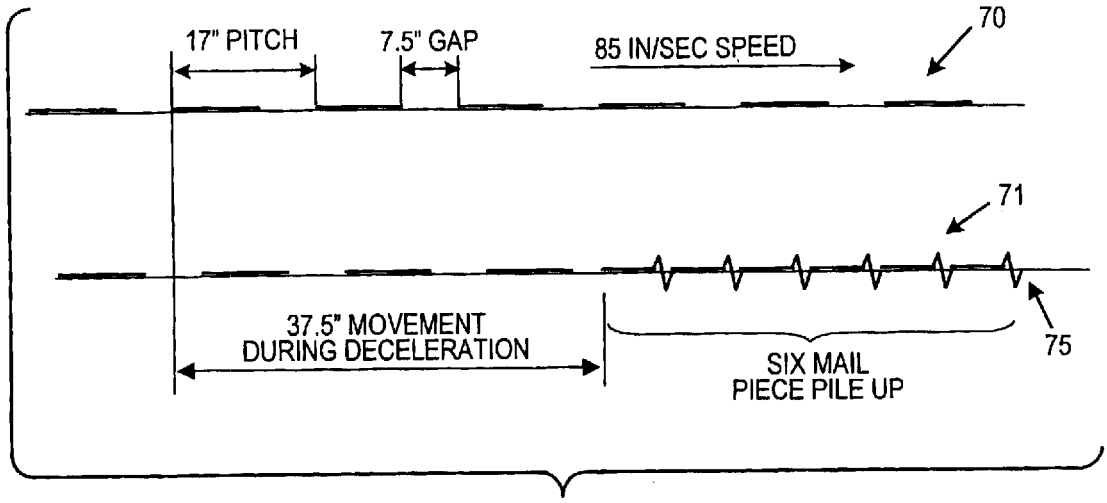
FIGS. 7A and 7B depict scenarios in which conveyed documents are damaged as a result of jams.

A further benefit of overlapping mail pieces is that upon the occurrence of a downstream jam, fewer mail pieces may be damaged. In FIG. 7A, the conventional linear and spaced arrangement of envelopes traveling on an inserter transport is depicted. Nominally, the conventional envelope transport 70 moves documents at speeds up to 85 ips, with a 17 inch distance between lead edge of one document to lead edge of the next document and a 7.5 inch gap between subsequent documents. When a downstream jam 75 occurs, and is detected the system is stopped. While stopping, the transport 70 typically requires about 37.5 inches of displacement during deceleration. As a result of this displacement, damage is caused to six envelopes 71 from end-to-end collisions and crumpling of envelopes upstream of the jam 75.

Figure 7B:
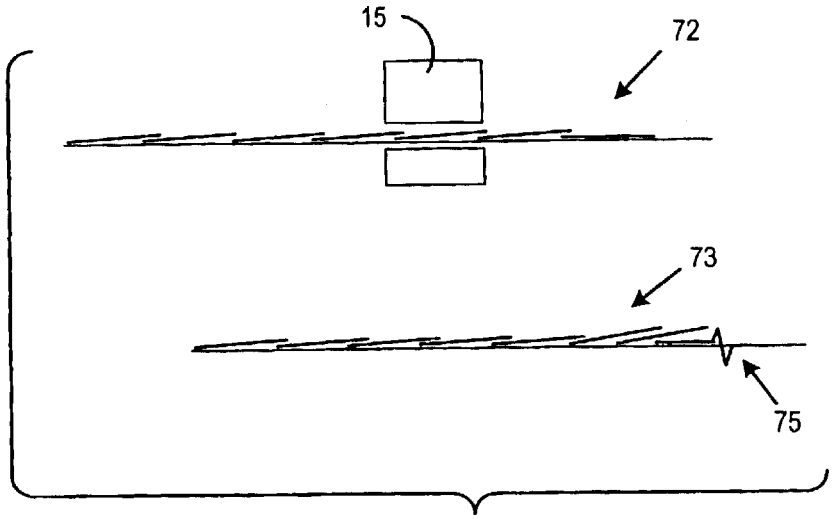

In contrast, in FIG. 7B, the envelope transport 72 is depicted during normal operation with overlapped envelopes in accordance with the present invention. Upon occurrence of a jam 75 among the overlapped documents, as few as one mail piece is damaged as upstream documents slide over the tops of downstream documents during deceleration.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A transporting system for use in a high velocity document processing system using lower velocity print technology, the system comprising:

a transport path comprising an upstream transport conveying spaced apart documents at a first transport velocity, a deceleration transport having a variable velocity downstream of the upstream transport, and a print transport transporting overlapped documents and having a print transport velocity the print transport velocity being less than the first transport velocity, the print transport located downstream of the deceleration transport;

a controller controlling the deceleration transport to decelerate an upstream document from the first transport velocity to the print transport velocity, the deceleration of the upstream document controlled so that a lead portion of the upstream document overtakes a trailing portion of an immediately downstream document moving at the print velocity;

an overlapping arrangement whereby the lead portion of the upstream document is urged to overlap the trailing portion of the downstream document when the upstream document overtakes the downstream document.

2. The transporting system in accordance with claim 1 wherein the overlapping arrangement is comprised of an upstream portion of the print transport being angled upward so that the trailing portion of the downstream document is angled lower than a horizontal transport plane of the deceleration transport when the downstream document is overtaken by the lead portion of the upstream document.

3. The transporting system in accordance with claim 1 wherein the overlapping arrangement is comprised of the deceleration transport having a first horizontal transport plane, the overlapping arrangement further including an upstream portion of the print transport having a second horizontal transport plane lower than the first horizontal transport plane such that the trailing portion of the downstream document is below the leading portion of the upstream document when the downstream document is overtaken by the lead portion of the upstream document.

4. The transporting system in accordance with claim 3 wherein the upstream portion of the print transport further includes an upper intake roller that guides the leading portion of the upstream document on top of the trailing portion of the downstream document.

5. The transporting system in accordance with claim 1 wherein the overlapping arrangement is comprised of a downward urging structure positioned above the transport and intersecting a transport plane between the deceleration transport and the print transport and proximal to an upstream portion of the print transport, the downward urging structure urging the trailing portion of the downstream document below the transport plane such that the leading portion of the upstream document on the transport plane will be above the trailing portion of the downstream document when the downstream document is overtaken by the lead portion of the upstream document.

6. The transporting system in accordance with claim 5 wherein the downward urging structure is a roller.

7. The transporting system in accordance with claim 5 wherein the downward urging structure is a ramp.

8. The transporting system in accordance with claim 1 wherein the overlapping arrangement is comprised of a upward urging structure positioned below the transport path and intersecting a transport plane between the deceleration transport and the print transport, the upward urging structure urging the leading portion of the upstream document above the transport plane such that the leading portion of the upstream document on the transport plane will be above the trailing portion of the downstream document when the downstream document is overtaken by the lead portion of the upstream document.

9. The transporting system in accordance with claim 8 wherein the upward urging structure is a roller.

10. The transporting system in accordance with claim 8 wherein the upward urging structure is a ramp.

11. The transporting system in accordance with claim 1 further comprising a print head contiguous with the print transport to print on overlapped documents transported at the print transport velocity.

12. The transporting system in accordance with claim 11 wherein a lead edge detector is located in the print transport portion of the transport path proximal to the print head, the print head performing printing operations on documents responsive to detection of lead edges of overlapped documents approaching the print head.

13. The transporting system in accordance with claim 12 wherein the lead edge detector comprises a floating dragging member that hangs in the transport path and that moves incrementally when it is hit by the leading edge of an overlapped document, the incremental movement generating a lead edge detection signal indicating the presence of the lead edge.

14. The transporting system in accordance with claim 13 wherein the dragging member is rotatably mounted at an end distal from the transport path, the rotational movement of the member being measured by a rotation sensor which provides the basis for the lead edge detection signal.

15. The transporting system in accordance with claim 11 wherein the print head is a rotary drum mechanical print head.

16. The transporting system in accordance with claim 11 wherein the print head is an ink jet print head.

17. The transporting system in accordance with claim 16 wherein the print head is above the print transport and the print transport further comprises one or more driven upper rollers and one or more floating lower rollers, the one or more upper rollers being fixedly positioned, the one or more lower rollers being vertically movable and upwardly biased to allow passage of different thicknesses of documents and overlapped documents in the print transport.

18. The transport system of claim 1 further comprising a first sensor located proximal to the deceleration transport, the first sensor detecting documents passing within the deceleration transport; and the controller controlling the deceleration of documents responsive to the first sensor sensing documents.

19. A method for transporting in a high velocity document processing system using lower velocity print technology, the method comprising:

transporting a spaced apart first document followed by a second document at a first transport velocity;

decelerating the first document to a print velocity;

decelerating the second document to the print velocity, the step of decelerating the second document including controlling the deceleration of the second document such that a leading portion of the second document overtakes a trailing portion of the first document;

overlapping the leading portion of the second document on the trailing portion of the first document;

transporting the overlapped first and second documents at the print velocity;

printing on the overlapped documents transported at the print velocity.

20. The method of claim 19 wherein the steps of decelerating documents further includes sensing the arrival of documents at a deceleration transport and commencing deceleration upon detection of the documents.

21. The method of claim 19 wherein the step of overlapping further includes angling the first document upward prior to being overtaken by the second document so that the trailing portion of the first document is lower than the arriving lead portion of the second document.

22. The method of claim 19 whereby the step of overlapping is carried out while the first and second documents are being transferred from a first horizontal plane to a second lower horizontal plane such that the trailing portion of the downstream document is below the leading portion of the upstream document when the downstream document is overtaken by the lead portion of the upstream document.

23. The method of claim 22 wherein the step of overlapping further includes guiding the leading portion of the upstream document on top of the trailing portion of the downstream document with an intake roller at the beginning of the second lower horizontal plane.

24. The method of claim 19 wherein the step of overlapping further includes downwardly urging from above the transport path the trailing portion of the downstream document so that the leading portion of the upstream document on the transport plane will be above the trailing portion of the downstream document when the downstream document is overtaken by the lead portion of the upstream document.

25. The method of claim 19 wherein the step of overlapping further includes upwardly urging from below the transport path the leading portion of the upstream document above the transport plane such that the leading portion of the upstream document on the transport plane will be above the trailing portion of the downstream document when the downstream document is overtaken by the lead portion of the upstream document.

26. The method of claim 19 further include the step of detecting a lead edge of the second overlapped document prior to the step of printing wherein the step of detecting a lead edge includes dragging a movable member on the overlapped documents and an incremental movement of the movable member indicating the lead edge of the second document, the step of printing on the second document occurring responsive to the detection of the lead edge.

27. The method of claim 19 wherein the step of transporting the first and second overlapped documents further includes driving the first and second overlapped documents from one or more fixed rollers above the overlapped documents, and supporting the overlapped documents from below on one or more floating lower rollers, the one or more upper rollers being fixedly positioned, the one or more lower rollers being vertically movable and upwardly biased.

* * * * *